United States Patent [19]

Girdler

[11] 4,059,853

[45] Nov. 29, 1977

[54] TIE CLASP

[75] Inventor: George W. Girdler, Fort Lauderdale, Fla.

[73] Assignee: Jack Steinberg, Hialeah, Fla. ; a part interest

[21] Appl. No.: 758,717

[22] Filed: Jan. 12, 1977

Related U.S. Application Data

[63] Continuation-in-part of Ser. No. 666,962, March 16, 1976, Pat. No. 4,024,585, which is a continuation-in-part of Ser. No. 613,172, Sept. 15, 1975, Pat. No. 3,958,277.

[51] Int. Cl.[2] ..... A41D 25/08

[52] U.S. Cl. ..... 2/152 A

[58] Field of Search ..... 2/150–153

[56] References Cited

U.S. PATENT DOCUMENTS

| | | | |
|---|---|---|---|
| 2,244,692 | 6/1941 | Hall | 2/150 |
| 2,504,887 | 4/1950 | Scott | 2/153 |
| 2,702,905 | 3/1955 | Peake | 2/153 |
| 2,931,045 | 4/1960 | France | 2/152 A |

*Primary Examiner*—G. V. Larkin

*Attorney, Agent, or Firm*—Robert B. Kennedy

[57] ABSTRACT

A tie clasp for supporting neckwear comprising a plate to be positioned on the front of a shirt collar and a hook mounted on the back of the plate for suspending the plate from the shirt collar. The hook defines an open-ended shirt collar receiving channel extending from adjacent the upper edge of the plate downwardly from the plate upper edge and away from the plate whereby upon placing a shirt collar within the hook receiving channel the lower edge of the tie clasp plate projects outwardly from the shirt. A neckwear receiving device is positioned on the back of the plate below the hook. The neckwear receiving device includes upper and lower parallel bars each segmented to define a central slot through which neckwear may be passed in suspending the neckwear from the receiving device bars with the neckwear ends draped in mutually lateral or overlaid positions, respectively.

9 Claims, 6 Drawing Figures

TIE CLASP

REFERENCE TO RELATED APPLICATIONS

This is a continuation-in-part of U.S. pat. application Ser. No. 666,962 filed Mar. 16, 1976 and now U.S. Pat. No. 4,024,585 which is a continuation-in-part of U.S. pat. application Ser. No. 613,172 filed Sept. 15, 1975, now U.S. Pat. No. 3,958,277.

BACKGROUND OF THE INVENTION

1. Field of the Invention

This invention relates generally to tie clasp for supporting neckwear, and particularly the tie clasp of the type adapted to be fitted on the front of a shirt collar with an item of neckwear suspended from the back thereof.

2. Description of the Prior Art

Heretofore, tie clasps have been devised by attachment to shirt collars between the collar wings from which clasps neckwear may be held pendant. As exemplified by U.S. Pat. Nos. 2,774,971, 3,588,918, 363,541, and 3,881,196, these devices have typically comprised a plate, means for attaching the plate to the collar, and a bar attached to, or a slot provided in, the plate forming a horizontal, upper tie support surface extending between the collar wings. With the clasp attached to the shirt collar, a necktie may be supported on the tie support surface with its end position overlaying each other beneath the clasp.

Though tie clasps of the type just described have functioned satisfactorily in supporting neckties draped vertically from the clasp, they have not been suited for supporting other forms of neckwear such as ascot ties, leisure ties or string ties having laterally suspended pendant ends. They have also been individually incapable of accommodating both neckwear sized to encircle a wearer's neck as well as that sized to bypass the neck. The prior devices have also exhibited only minimally acceptable stability in use as they have often tended to become skewed.

As shown in U.S. Pat. No. 3,365,726, devices have also been made for use with necktie knot simulators to cause a lower part of the simulator to project outwardly from the shirt with the upper part attached to the shirt collar to provide the appearance of a real necktie knot. These devices have included an adjustable pin or the like which extends rearwardly from a lower part of the knot simulator against that portion of the wearer's shirt that overlays his throat or "Adam's Apple". These devices, however, are not readily adaptable for use with tie clasps of the types previously described since the pin displaces the tie away from the clasp and against the wearer's shirt. Moreover, even were such devices to be used many users would find the pressure applied at a point on his throat or Adam's Apple to be discomforting.

Accordingly, it is a general object of the present invention to provide an improved tie clasp.

More specifically, it is an object of the invention to provide a tie clasp from which neckwear ends may be draped in mutually lateral or overlaid positions.

Another object of the invention is to provide a tie clasp from which neckwear may be suspended sized either to encircle or to by-bass the wearer's neck.

Another object of the invention is to provide a tie clasp which may be readily attached to a shirt collar and held snugly in place during use.

Another object of the invention is to provide a tie clasp of the type described which projects smartly outwardly from the shirt collar when attached thereto.

Another object of the invention is to provide a tie clasp of the type described to which neckwear may be readily and easily mounted and suspended in either mutually lateral or overlaid positions.

Yet another object of the invention is to provide a tie clasp of the type described capable of forming a central dimple or crease in the tie just beneath the clasp.

Still another object of the invention is to provide a tie clasp of the type described of relative simple and economic construction.

SUMMARY OF THE INVENTION

In one form of the invention a tie clasp is provided for supporting neckwear comprising a plate adapted to be positioned on the front of a shirt collar. Hook means are mounted on the back of the plate for suspending the plate from the shirt collar. Neckwear receiving means are positioned on the back of the plate below the hook means with the neckwear receiving means including upper and lower parallel bars each segmented to define a central slot through which neckwear may be passed in suspending the neckwear from the receiving means bars with the neckwear ends draped in mutually lateral or overlaid positions, respectively.

In another form of the invention a tie clasp is provided for supporting neckwear comprising a plate adapted to be positioned on the front of a shirt collar and neckwear receiving means on the back of the plate to which neckwear may be received and suspended. Hook means are mounted on the back of the plate for suspending the plate from the shirt collar. The hook means defines an open-ended shirt collar receiving channel extending from adjacent the upper edge of the plate downwardly from the plate upper edge and away from the plate whereby upon placing a shirt collar within the hook means receiving channel the lower edge of the tie clasp plate projects outwardly from the shirt.

DESCRIPTION OF THE PREFERRED EMBODIMENT

Referring now in more detail to the drawings, there is shown a tie clasp 10 comprising a metal plate 11 formed in the general shape of a shield having bilateral symmetry. The front surface of the plate is formed slightly convex while the rear surface is formed slightly concaved. The front surface has a square recess 13 in a central portion thereof sized to contain the head of a rivet extending through a central aperture 15.

Figure 2:
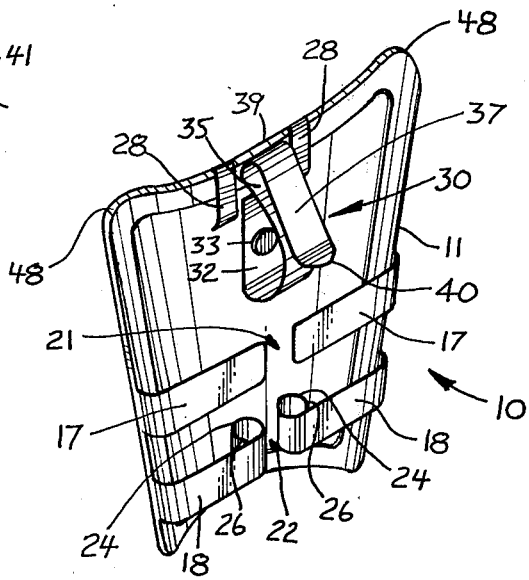
FIG. 2 is a perspective view of the back of the tie clasp shown in FIG. 1.
Figure 3:
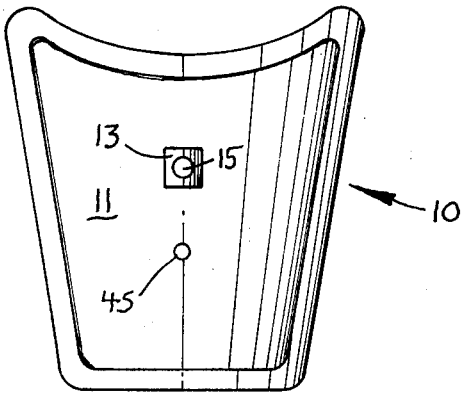
FIG. 3 is a front elevational view of the tie clasp shown in FIG. 1 with the decorative portion removed to reveal structual features therebeneath.

With particular reference to FIG. 2 the clasp is shown to include an upper, segmented bar 17 and a lower segmented bar 18 oriented parallel with the upper bar. The upper bar is segmented to define a slot 21 while the lower bar is similarly segmented to define a central slot 22. The lower bar segments which defines the central slot are seen to be curved inwardly in a generally cylindrical fashion to form two stay tabs 24. So formed, the stay tabs present mutually facing, convex surfaces defining the central slot through which neckwear may be easily slipped. The ends 26 of the stay tabs face that surface of the lower segmented bar which faces the plate and thereby provides a recess for holding neckwear in place after it has been passed through the central slot and laterally over the stay tabs. The segmented upper and lower bars are seen to be formed unitarily with the plate whereby the plate and bars may be formed from a single blank. Similarly, two stay tabs 28 are formed unitarily with an upper edge of the plate.

With continued reference to FIG. 2 the tie clasp is further seen to include a hook 30. The hook is made of a strip of resilient metal into the general shape of the letter S or "goose neck". The S-shaped hook has an elongated leg 32 mounted flush to the rear surface of plate 11 by rivet head 33. The rivet shank extends through hole 15 with the rivet head on the front of the plate disposed within recess 13. The presence of the two stay tabs 28 prevent the hook from rotating about the rivet shank. The other two elongated legs 35 and 37 of the generally S-shaped hook define a shirt collar receiving channel which extends downwardly from the upper edge 39 of plate 11 and away from the rear surface of the plate. The end 40 of the hook is flared slightly to facilitate entry of the shirt collar into the mouth of the channel. A cork face plate 41 is glued to the front of the plate 11 smoothly overlaying recess 13 and rivet head 15. A decorative ornament, here in the shape of a bull's head 43 is then secured to the plate overlaying the cork plate by a spot weld 45.

Figure 1:
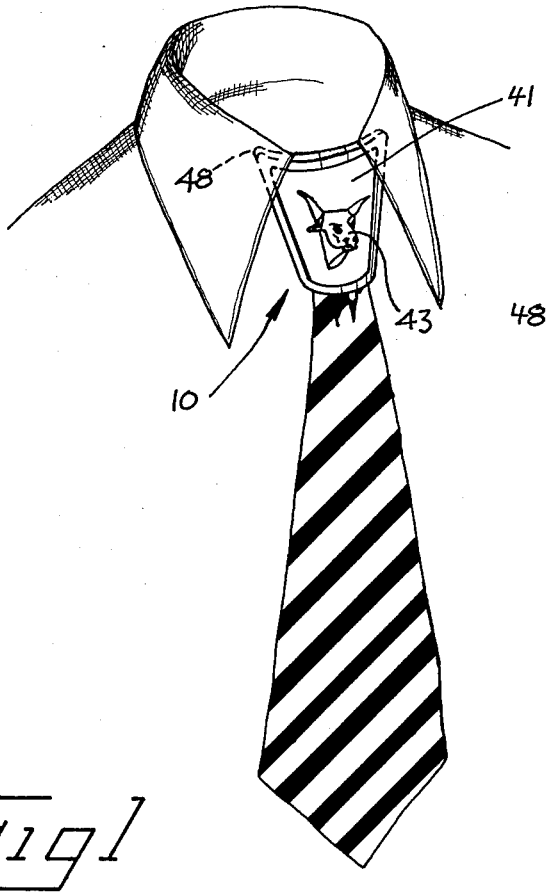
FIG. 1 is a perspective view of the front of the tie clasp embodying principles of the invention in one form.
Figure 4:
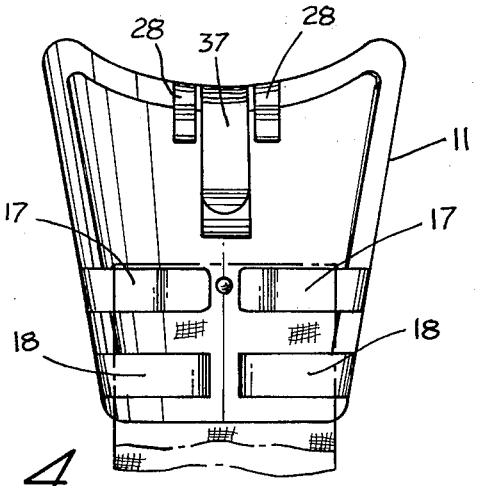
FIG. 4 is a rear elevational view of the tie clasp shown in FIG. 1 together with a necktie suspended therefrom with its pendant ends in mutually overlaying relation.

In use, a four-in-hand tie may be suspended from the tie clasp as shown in FIG. 4. This may be accomplished by gripping the tie clasp with the left hand while holding it in the general position shown in FIG. 2. The tie may then be positioned in the right hand in an overlaid position and then one of the two overlaid folds passed simultaneously through the two slots in the upper and lower segmented bars. After having passed through the slots the tie is smoothed laterally into the position shown in FIG. 4. The presence of the two neckwear retaining tabs 24 assists in maintaining the position of the tie upon the clasp while also serving to form a dimple or vertical crease in that portion of the necktie immediately beneath the clasp. The assembly is then positioned in front of and slightly above the top edge of the shirt collar between the collar wings. The device is next hung upon the collar by introducing the collar into the open-ended shirt collar receiving channel of the hook 30. The upper corners 48 of the plate are finally nestled behind the wings of the shirt collar as shown in FIG. 1. The slope of the necktie receiving channel of the hook causes the lower edge of the clasp to project outwardly from the shirt.

Figure 5:
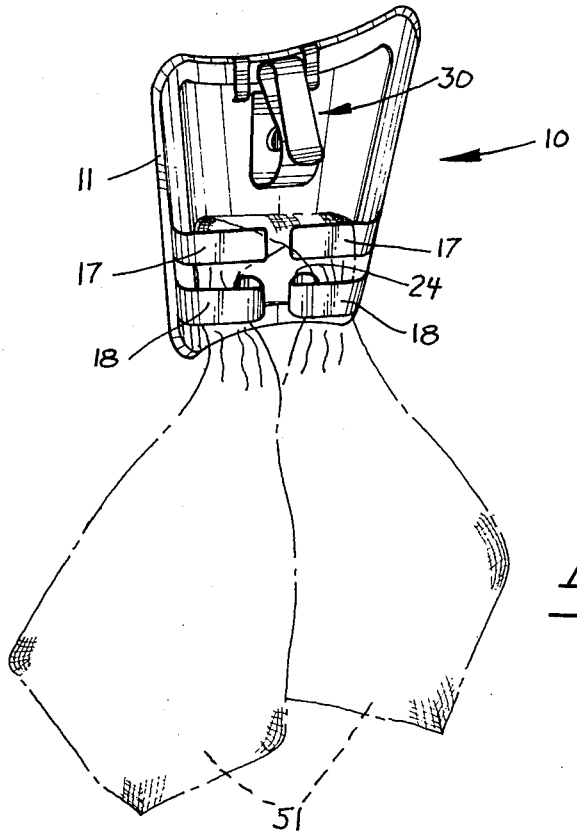
FIG. 5 is a perspective view of the rear of the tie clasp shown in FIG. 1 together with ascot type neckwear suspended therefrom without encircling the wearer's neck.
Figure 6:
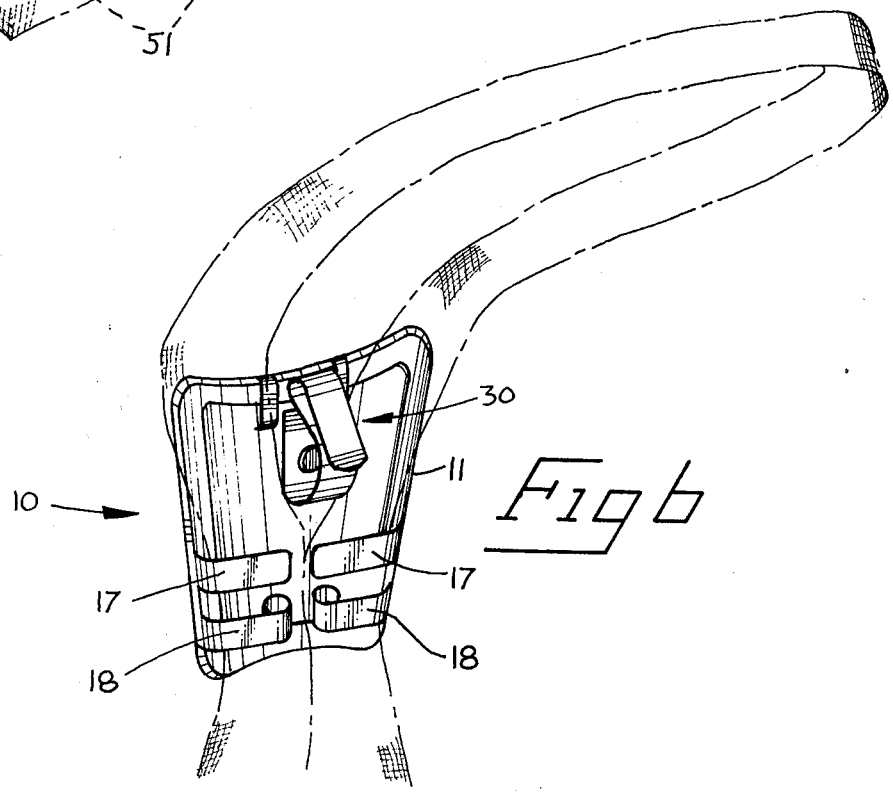
FIG. 6 is another perspective view of the tie clasp shown in FIG. 1 supporting ascot type neckwear which does encircle the wearer's neck.

With reference next to FIGS. 5 and 6 it will be seen that the tie clasp may also be used in suspending neckwear therefrom with the neckwear ends in mutually lateral positions. In FIG. 5 ascot type neckwear is seen to be suspended with its end portions 51 laterally displaced with but a slight overlay thereof. In mounting the neckwear to the clasp a mid-portion of the tie is again slid simultaneously through the central slots in the upper and lower bars 17 and 18. That portion which has been passed through the slots is then moved to the left, as viewed in FIG. 5, behind the left segment of the upper and lower bars and into snug engagement within the recess defined by the lower bar segment 18 and the neckwear retaining tab 24 formed unitarily therewith. The top of the tie thus overlays both segments of the upper bar 17. Following this the other portion of the tie is slid through the lower slot and then to the right as viewed in FIG. 5 aside the neckwear retaining stay 24 on the right side of the lower slot. The width of the space aside the two neckwear retaining stays or tabs enables the neckwear to be crimped slightly with vertical creases appearing just beneath the clasp as shown in FIG. 5.

In FIG. 6 neckwear encircling the wearer's neck is shown to be mounted to the clasp with the pendant ends in mutually lateral placement. In this case one fold of the neckwear is positioned behind the left segment of both the upper and lower bars 17 and 18 to the left side of hook 30 while the other fold is positioned to the right side of the hook beneath the right segments of the upper and lower bars. Again, the necktie retaining tabs 24 hold the neckwear in position and, if desired, serve to form a vertical crease therein exposed to view from just below the clasp.

It thus is seen that a quite versatile tie clasp is provided of relatively simple and economic construction in which many of its parts, including the plate, the various bars, neckwear retaining tabs, and stay tabs may all be formed from a unitary blank. The clasp includes a hook again formed of one unitary strip of resilient metal that is readily affixed to the plate by a rivet, spot welding or the like. The clasp may be easily mounted to the shirt collar in such a manner that the lower end projects smartly from the shirt by virtue of the placement of the clasp hook upon the collar. Neckwear may be then easily mounted and positioned to the clasp with the ends overlaying or laterally displaced and with or without the neckwear encircling the wearer's head.

It should be understood that the just described embodiment merely illustrates principles of the invention in one preferred form. Many modifications, additions and deletions may, of course, be made thereto without departure from the spirit and scope of the invention as set forth in the following claims.

I claim:

1. A tie clasp for supporting neckwear comprising a plate adapted to be positioned on the front of a shirt collar; hook means mounted on the back of said plate for suspending said plate from the shirt collar; and neckwear receiving means positioned on the back of said plate below said hook means with said neckwear receiving means including upper and lower generally parallel bars each segmented to define a central slot through which neckwear may be passed in suspending the neck wear from the receiving means bars with the neckwear ends draped in mutually lateral or overlaid positions, respectively, and wherein at least one of said bars has a pair of inwardly directed neckwear retaining tabs straddling said one bar central slot; and wherein said neckwear retaining tabs are generally cylindrical thereby presenting convex surfaces facing said one bar central slot over which neckwear may be smoothly passed through the slot.

2. A tie clasp in accordance with claim 1 wherein end portions of said generally cylindrical tabs face the side of said one bar adjacent said plate thereby to form recesses in which the neckwear may be held between the plate and bar.

3. A tie clasp for supporting neckwear comprising a plate adapted to be positioned on the front of a shirt collar; hook means mounted on the back of said plate for suspending said plate from the shirt collar; which includes a shirt collar receiving channel extending in a direction downwardly from adjacent the upper edge of said plate and away from the rear of said plate whereby the lower edge of the plate projects outwardly from the shirt when the shirt collar is placed within the hook means receiving channel; and neckwear receiving means positioned on the back of said plate below said hook means with said neckwear receiving means including upper and lower generally parallel bars each segmented to define a central slot through which neckwear may be passed in suspending the neckwear from the receiving means bars with the neckwear ends draped in mutually lateral or overlaid positions, respectively.

4. A tie clasp for supporting neckwear comprising a plate adapted to be positioned on the front of a shirt collar; neckwear receiving means on the back of said plate to which neckwear may be received and suspended; and hook means mounted on the back of said plate for suspending said plate from the shirt collar, and wherein said hook means defines an open-ended shirt collar receiving channel extending from adjacent the upper edge of said plate downwardly from the plate upper edge and away from said plate whereby upon placing a shirt collar within the hook means receiving channel the lower edge of the tie clasp projects outwardly from the shirt.

5. A tie clasp in accordance with claim 4 wherein said hook means comprises a unitary strip of resilient metal in the general shape of the letter S.

6. A tie clasp in accordance with claim 5 wherein said S-shaped strip metal has three elongated legs with one leg mounted flush to said plate and with the other two legs defining said open-ended shirt collar receiving channel.

7. A tie clasp in accordance with claim 6 wherein said one strip leg is riveted to said plate, and wherein said hook means further includes a pair of stay tabs formed unitarily with said plate between which at least a portion of said S-shaped strip of metal is sandwiched whereby the stay tabs inhibit rotary movement of the S-shaped strip of metal about the rivet.

8. A tie clasp in accordance with claim 4 wherein said neckwear receiving means comprises upper and lower parallel bars each segmented to define a central slot through which neckwear may be passed in suspending the neckwear from the receiving means bars with the neckwear ends draped in mutually lateral or overlaid positions, respectively.

9. A tie clasp in accordance with claim 8 wherein one of said segmented bars has a pair of inwardly directed neckwear retaining tabs straddling said one bar central slot.

* * * * *